US010518955B2

(12) United States Patent
Kuhlman

(10) Patent No.: US 10,518,955 B2
(45) Date of Patent: Dec. 31, 2019

(54) PORTABLE HUMIDIFICATION DEVICE

(71) Applicant: Whippet Innovations, LLC, Lincoln, NE (US)

(72) Inventor: Timothy Kuhlman, Lincoln, NE (US)

(73) Assignee: Whippet Innovations, LLC, Lincoln, NE (US)

( * ) Notice: Subject to any disclaimer, the term of this patent is extended or adjusted under 35 U.S.C. 154(b) by 36 days.

(21) Appl. No.: 15/933,640

(22) Filed: Mar. 23, 2018

(65) Prior Publication Data

US 2019/0185243 A1 Jun. 20, 2019

Related U.S. Application Data

(60) Provisional application No. 62/475,555, filed on Mar. 23, 2017.

(51) Int. Cl.

| | |
|---|---|
| ***B65D 51/30*** | (2006.01) |
| ***B65D 81/26*** | (2006.01) |
| ***B65D 81/22*** | (2006.01) |
| ***A24F 25/02*** | (2006.01) |
| *B65D 81/24* | (2006.01) |

(52) U.S. Cl.

CPC ..... *B65D 81/264* (2013.01); *A24F 25/02* (2013.01); *B65D 81/22* (2013.01); *B65D 81/24* (2013.01)

(58) Field of Classification Search

CPC ..... B65D 51/30; B65D 81/26; B65D 81/267; B65D 81/268; B65D 81/264; B65D 81/265; B65D 81/266

USPC ..... 206/204

See application file for complete search history.

(56) References Cited

U.S. PATENT DOCUMENTS

| | | | | |
|---|---|---|---|---|
| 2004/0226834 | A1* | 11/2004 | Baldwin, Jr. | B32B 7/08 206/204 |
| 2007/0299489 | A1* | 12/2007 | Francis, Jr. | A41D 13/0058 607/108 |
| 2008/0031553 | A1* | 2/2008 | Tokita | B65D 33/2508 383/113 |
| 2010/0000896 | A1* | 1/2010 | Keats | A01G 9/023 206/423 |
| 2013/0334074 | A1* | 12/2013 | Wada | B65D 81/26 206/204 |
| 2015/0320113 | A1* | 11/2015 | Stebbins | A24F 23/02 206/740 |

OTHER PUBLICATIONS

Boveda, Boveda 58 Percent RH 2-Way Humidity Control, 4 gram, 10 pack, pp. 1-8, https://www.amazon.com/Boveda-Percent-2-Way-Humidity-Control/dp/B06XB3NP4C/.

(Continued)

*Primary Examiner* — King M Chu

(74) *Attorney, Agent, or Firm* — Suiter Swantz pc llo

(57) ABSTRACT

The present disclosure is a portable humidification device. The portable humidification device may include a container and may further include at least one wall coupled to the container that includes one or more openings configured to allow passage of vapor from the container to an environment within an enclosure in order to maintain a desired level of humidity within the enclosure. The portable humidification device may include a liquid within the container and may optionally include a liquid absorbing material within the container to adjust the distribution of vapor over time.

7 Claims, 9 Drawing Sheets

(56) References Cited

OTHER PUBLICATIONS

Boveda, Boveda 62 Percent RH 2-Way Humidity Control, 4 gram, 10 Pack, pp. 1-9, https://www.amazon.com/Boveda-Percent-2-Way-Humidity-Control/dp/B06XB26Q8N/.
Boveda, Boveda 69 Percent RH (320 Gram)—2-Way Humidity Control Pack, pp. 1-7, https://www.amazon.com/BOVEDA-69-Percent-320-GRAM/dp/B01MUBFK0S/.
MEK Distributing, Cigar Caddy Golf Gift Set Mini Golf Bag Humidor Triple Flame Torch Lighter Cutter Cigar Holder, pp. 1-7, https://www.amazon.com/Humidor-Triple-Lighter-Cutter-holder/dp/B00ADVV3NY/.
Moisture Discs, Moisture Pouch Buttons for Fresh Tobacco, pp. 1-6, https://www.amazon.com/Moisture-Pouch-Buttons-Tobacco-Discs/dp/B00326GR9W/.

* cited by examiner

PORTABLE HUMIDIFICATION DEVICE

CROSS REFERENCE TO RELATED APPLICATIONS

The present application claims the benefit under 35 U.S.C. § 119(e) of U.S. Provisional Application Ser. No. 62/475,555 filed Mar. 23, 2017. The U.S. Provisional Application Ser. No. 62/475,555 is hereby incorporated by reference in its entirety.

TECHNICAL FIELD

The present disclosure generally relates to the field of portable consumer products, and more particularly to a portable humidification device which may be employed within an enclosure to maintain a desired humidity level within the enclosure.

BACKGROUND

There are a variety of products which require a desired level of humidity in order to provide improved taste, or performance. For example, cigars, herbs, spices and seeds may have improved taste or performance when they are maintained at a desired level of humidity. There are conventional humidors which are designed for long term storage of products, such as cigars. However, conventional humidors are not suitable to maintain a desired level of humidity within an enclosure which allows for shipment and transfer of products in an efficient and convenient manner.

SUMMARY

The present disclosure is directed to a portable humidification device. The portable humidification device may include a container and may further include at least one wall coupled to the container that includes one or more openings configured to allow passage of vapor from the container to an environment within an enclosure in order to maintain a desired level of humidity within the enclosure. The portable humidification device may include a liquid within the container and may optionally include a liquid absorbing material within the container to adjust the distribution of vapor over time.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1:
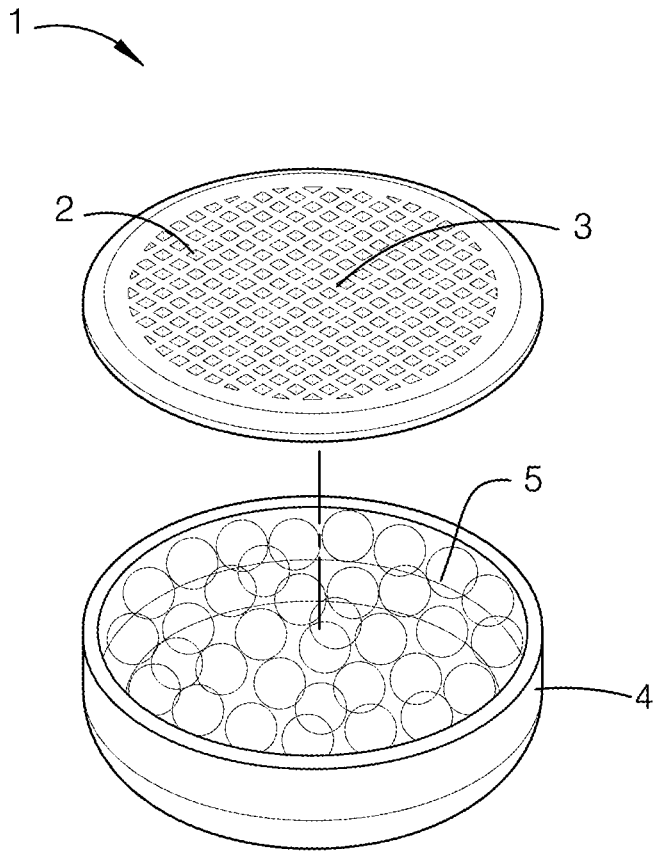
FIG. 1 depicts a perspective view of a portable humidification device in accordance with an embodiment of the present disclosure.

Reference will now be made in detail to the subject matter disclosed, which is illustrated in the accompanying drawings.

Before any embodiments of the disclosure are explained in detail, it is to be understood that the embodiments may not be limited in application per the details of the structure or the function as set forth in the following descriptions or illustrated in the figures. Different embodiments may be capable of being practiced or carried out in various ways. Also, it is to be understood that the phraseology and terminology used herein is for the purpose of description and should not be regarded as limiting. The use of terms such as "including," "comprising," or "having" and variations thereof herein are generally meant to encompass the item listed thereafter and equivalents thereof as well as additional items. Further, unless otherwise noted, technical terms may be used according to conventional usage. It is further contemplated that like reference numbers may describe similar components and the equivalents thereof.

The present disclosure is directed to a portable humidification device. The portable humidification device may include a container and may further include a wall coupled to the container that includes one or more openings configured to allow passage of vapor from the container to an environment within an enclosure in order to maintain a desired level of humidity within the enclosure. The portable humidification device may include a liquid within the container and may optionally include a liquid absorbing material within the container to adjust the distribution of vapor over time. Portable humidification device may be configured to provide passive humidification.

While other conventional humification devices intended for use within an enclosure may be available, they provide limited, and inconsistent, humidification and have a number of drawbacks. Conventional humidification devices may be formed solely of a rigid material with large holes to allow liquid to be passed into the conventional humidification device. However, the large holes create a situation which limits an operating life of the device because air from the environment may easily pass into the conventional humidification device. Also, conventional humidification devices which include the large holes are subject to leakage. Consequently, liquid from the conventional humidification device may pass through the holes and into the enclosure, causing damage to the product which is kept in the enclosure and intended for humidification.

Referring to FIGS. 1-8, various embodiments of a portable humidification device 1 are shown. Portable humidification device 1 may include a wall 2 which may be removably coupled or removably connected with a container 4. Container 4 may be a solid, open-ended, device formed of a rigid material, such as metal, rubber, plastic, polycarbonate, stone, ceramic, or composite material and may be formed into various shapes.

Wall 2 may be formed of a flexible material and may be formed of a single material or combination of materials. For example, wall 2 may be formed of rubber, urethane, and composite materials which are configured to allow the wall 2 to be flexible and subject to movement. In one embodiment, wall 2 may be formed of hydrolytically stable, polyester thermoplastic urethane. Wall 2 may include one or more openings 3 which allows passage of vapor from within the container and through one or more openings 3 into the environment surrounding the portable humidification device 1. It is contemplated that the one or more openings 3 of the wall 2 may include a single opening, at least one opening, multiple openings, or continuous perforated material with a plurality of openings which may be formed in a decorative design.

Wall 2, may contain any liquid and any liquid absorbing material within the container 4 without leakage through the wall or the one or more openings of the wall 2. It is contemplated that wall 2 may prevent dripping or leakage of a liquid from the interior of the container due to the small opening size(s) of the one or more openings whereby sufficient surface tension is developed on the interior portion of the wall to prevent any passage of liquid from the container 4 through the one or more openings. Advantageously, the use of one or more small openings prevents any leakage of liquid from the container 4 and into the enclosure in which it may be placed, preventing any damage to the product intended for humidification. Furthermore, the wall 2 may be formed of a sufficient thickness, such as 0.06 inches or greater, which prevents transfer of any liquid out of the container while still providing the wall 2 with flexure and flexibility.

The same surface tension that is created with use of the one or more small openings in the wall may prevent the transfer of liquid into the container through the one or more openings 3 of the wall 2. This may hinder a user's ability to re-hydrate or re-fill the container with liquid when attempting to pass liquid through the one or more openings 3 of the wall 2. However, wall 2, formed of a flexible material, such as rubber, may further include an amount of flexure and movement of the material of the wall 2 necessary to mechanically force the removal of air from the container and create a pump action in order to pass liquid through the one or more openings 3 and into the container 4, when submerged in a liquid or a stream of liquid, shown in an exemplary fashion in FIG. 8A and FIG. 8B. By employing one or more small openings 3 in the wall 2 formed of a flexible material, wall 2 may only allow vapor to pass, prevent leakage, and still allow re-fill of liquid into the container by creating a pump action. Therefore, portable humidification device 1 may provide humidification for a significantly longer period of time than conventional humification devices.

Figure 4:
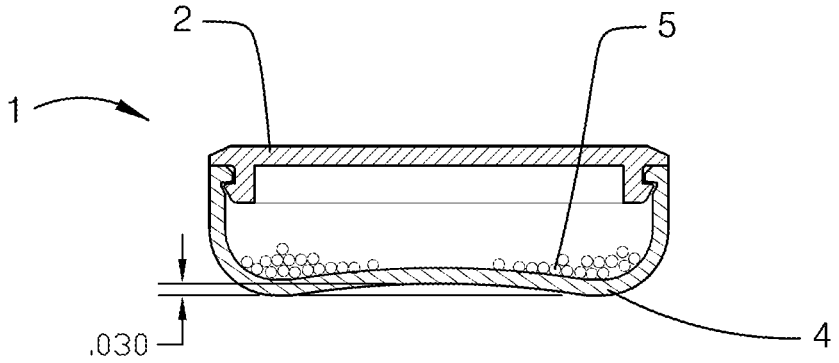
FIG. 4 depicts a side view of a portable humidification device in accordance with an embodiment of the present disclosure.

Wall 2 may be implemented as a cap, such as a top wall to a container, as shown or may be implemented as a side wall which extends around the periphery of the portable humidification device. Wall 2 may be configured to be generally permanently connected to the container whereby liquid would be passed through the openings in order for the portable humidification device to continue to provide humification. Alternatively, it is contemplated that wall 2 may be mechanically attached to the container 4 or an adhesive may be applied between the wall 2 and container 4. As shown in FIG. 4, wall 2 may be removably connected with container 4 through a locking shaped engagement, such as a threaded connection. It is contemplated that a removable wall 2 may allow for re-fill of liquid absorbing material 5 or may allow for re-fill of liquid for the portable humidification device 1 without requiring the liquid to pass through the one or more openings of the wall 2.

Liquid absorbing material 5 may be located within the container 4. It is contemplated that liquid absorbing material 5 may improve and extend the discharge of vapor from the container in order to maintain a desired humidity within an enclosure. Liquid absorbing material 5 may be a moisture-retaining and controlled humidity-discharging material, and may include sponge material, silica, or polymer crystals.

The liquid absorbing material 5 may be in rough crystal, fiber and spherical or bead form. Often, the liquid absorbing material 5 may be in super absorbing polymer (SAP) crystal form, which may be in the form of spherical pieces, 1.5 mm in diameter, referred as beads or bead form. It is contemplated that the size of the one or more openings 3 of wall 2 may be sized to retain the liquid absorbing material 5 when the material is in dry form and prevent any leakage from the container 4 when the container 4 is filled with a liquid. It is contemplated that liquid may include water, propylene glycol, and other liquids without departing from the scope and intent of the present disclosure. It is contemplated that propylene glycol may be retained longer within the liquid absorbing material in order to extend the life of the portable humidification device 1 before the device 1 needs to be re-hydrated to continue humidification. When a liquid is added to liquid absorbing material 5, the solid form of the liquid absorbing material may mix with the liquid and create a gel-like consistency. The gel-like consistency may be maintained until the liquid is converted to a vapor and the liquid absorbing material 5 returns to a solid form. Container 4 may be filled with an amount of liquid absorbing material 5 which fills the container 4 when the container 5 is fully hydrated with liquid.

Figure 2:
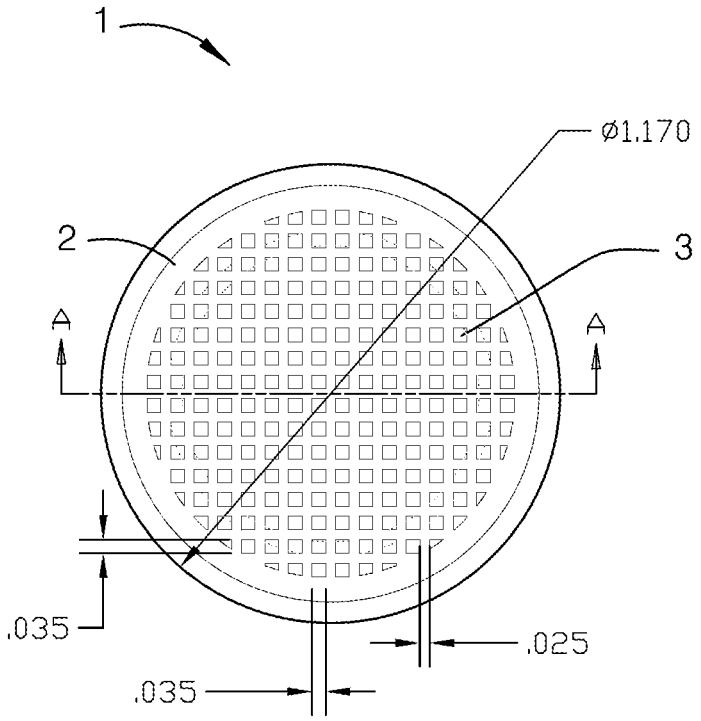
FIG. 2 depicts a top view of a portable humidification device in accordance with an embodiment of the present disclosure.
Figure 3:
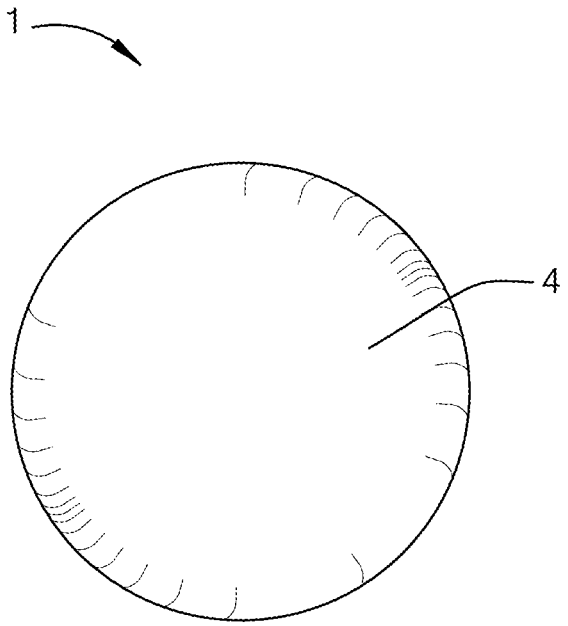
FIG. 3 depicts a bottom view of a portable humidification device in accordance with an embodiment of the present disclosure.

Referring to FIG. 2, a top view of a portable humidification device 1 in accordance with an embodiment of the present disclosure is shown. While cigars and other products may be stored within a humidor, conventional humidors are of a size which does not allow easy carry and transport of cigars. Portable humidification device 1 may be sized to fit within a small enclosure, and thus may provide humidification for portable and for shipping applications. For cigar transport, enclosure may be a five-inch by eleven-inch sealable bag. In one embodiment, portable humidification device 1 may have a similar shape and roughly a similar diameter as a quarter (a U.S. currency coin). For example, the portable humidification device 1 may have a diameter of 1.17 inches. Advantageously, due to its shape, similar to a size of a quarter, the humidification device 1 may be placed within an enclosure and easily transported in a pocket, bag, or purse of a user with minimal inconvenience.

Each opening of the one or more openings 3 may be sized from a range of 0.0315-0.0385 inches and may be preferably sized to be 0.035 inches. After experimentation, it was determined that a range of 0.0315-0.0385 inches for an opening was large enough to effectively allow vapor to pass through the wall while small enough to prevent any leakage of liquid from the container and through the one or more openings. It is contemplated that spacing between each opening of the one or more openings 3 may be 0.0225-0.0275 inches and may be preferably 0.025 inches. While the openings are depicted as squares, it is contemplated that circles and various other shapes may be employed without departing from the scope and intent of the present disclosure.

Figure 5:
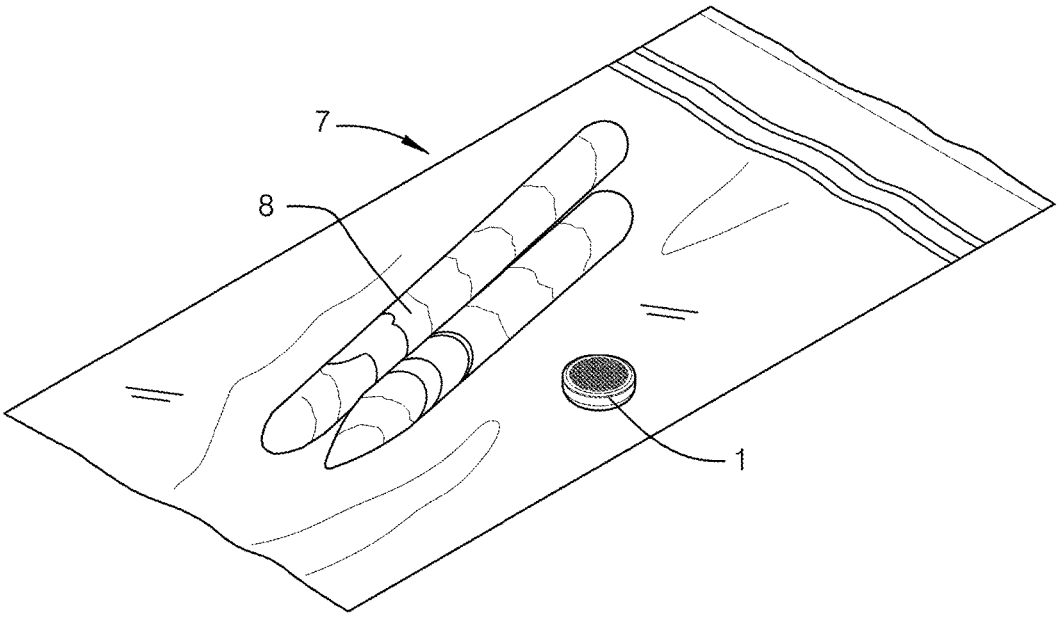
FIGS. 5-7 depicts a portable humidification device within an enclosure in accordance with an embodiment of the present disclosure.
Figure 6:
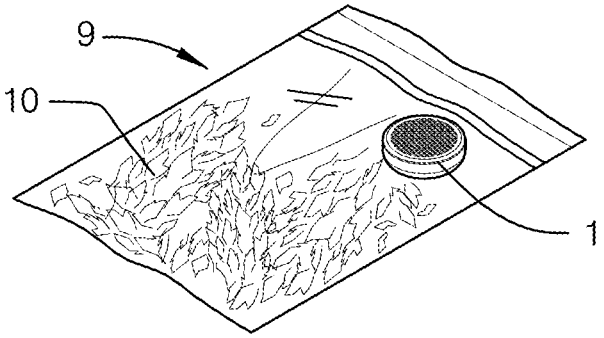
Figure 7:
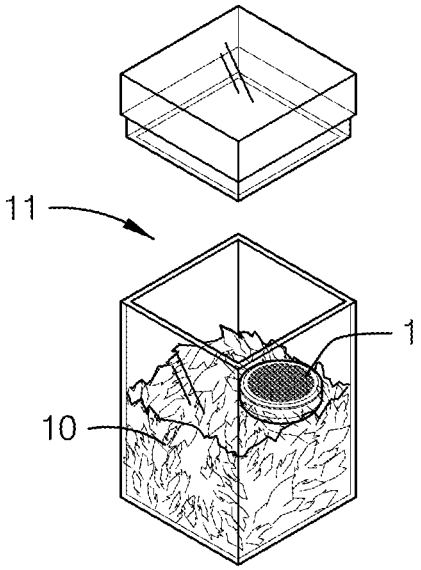

Referring to FIGS. 5-7, a portable humidification device within an enclosure in accordance with an embodiment of the present disclosure is shown. FIG. 5 depicts a portable humidification device 1 within a cigar-sized point of sale/transport enclosure 7, such as a plastic sealable bag, may include one or more cigars 8. Plastic sealable bag may be a ZIPLOC bag but other types of sealable bags may also be employed without departing from the scope and intent of the present disclosure. Referring to FIG. 6, a portable humidification device 1 within an enclosure 9 which may include herbs, seeds, or spices 10 is shown. Referring to FIG. 7, a portable humidification device 1 within a sealable box that includes a removable lid 11 which may include herbs, seeds, or spices 10 is shown.

Figure 8A:
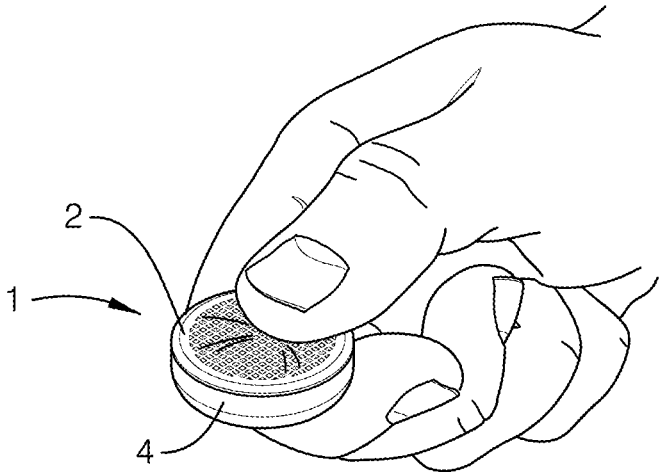
FIGS. 8A and 8B depicts a flexible property of the wall of the container of the portable humidification device which may allow liquid to pass through the plurality of openings of the at least one wall and within the container in accordance with an embodiment of the present disclosure.
Figure 8B:
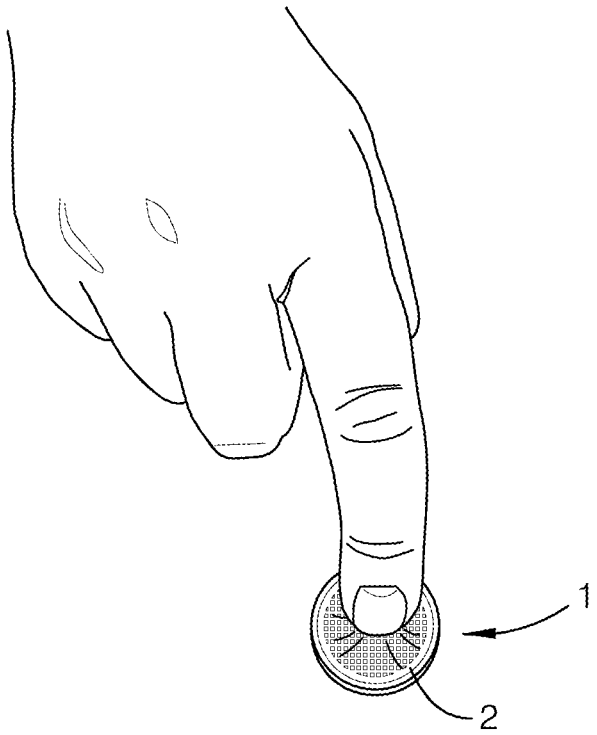

Referring to FIGS. 8A and 8B, a flexible property of wall 2 of portable humification device 1 which may allow liquid to pass through the one or more openings of the wall within the container 4 in accordance with an embodiment of the present disclosure is shown. It is contemplated that when the portable humidification device 1 may require re-hydration in order to continue to provide humidification, the liquid absorbing material may be in a solid form and be reduced in volume in comparison to a gel-like form when it is hydrated. As such, shaking of the liquid absorbing material may create an audible noise and thus may provide an alert to the user that the portable humidification device 1 requires re-hydration or a re-fill of liquid. Audible noise may be in a form of a rattle. As air fills the remaining space within the container 4 of the portable humidification device 1 left by the reduction of volume occupied by the mixture of liquid and liquid absorbing material, it may be possible for a user to press the wall 2 within the container 4. When the wall is depressed, air from within the container 4 is released and may cause liquid to be pumped through the one or more openings of the wall when the container 4 is submerged in liquid or a stream of liquid.

In another embodiment of the disclosure, it is contemplated that the audible alert, in form of a rattle by movement of contents within the container when the liquid absorbing material has returned to a solid, may be amplified. For example, the audible alert may become more apparent by addition of additional objects, formed of metal or stone, which would additionally move when the liquid absorbing material is in solid form. The additional objects may be ball bearings, birdshot, and the like which may be very mobile within a container 4 as spherical objects and thus continually may strike interior walls of the portable humidification device 1 creating a rattle which would indicate the portable humidification device 1 requires re-hydration or re-fill of liquid.

Also, it is contemplated that when liquid absorbing material returns to solid form, it may become stuck or attached to an interior wall of the portable humidification device 1. Even in the example of liquid absorbing material in the form of spherical objects or beads, as the liquid absorbing material dries, it may attach to a wall of the portable humidification device 1. When the liquid absorbing material attaches to an interior wall of the portable humidification device 1, the desired audible alert to signal the portable humidification device 1 requires a re-fill of liquid may be prevented. In an embodiment of the disclosure, the interior walls of the portable humidification device 1 may include a rough, jagged, surface. A rough, jagged surface may prevent a clear surface and thus prevent the attachment of the liquid absorbing material to the interior wall when the liquid absorbing material dries. It is contemplated that the rough, jagged surface may be applied to the interior of the container 4 by providing a raw and unpolished finish, a shot blasted finish, a sand blasted finish, or an etched or chemically etched finish. Other methods to produce a rough surface may also be employed without departing from the scope and intent of the present disclosure.

Portable humidification device 1 may be particularly useful in arid regions and dry climates where the relative humidity may be low. Relative humidity may refer an amount of vapor present in air as expressed as a percentage of the amount needed for saturation at the same temperature. For example, a low relative humidity may be a percentage of less than 50%. It is contemplated that some products may be preserved better in a humidity level greater than 50%, such as 60% relative humidity, 65% percent relative humidity, or 70% relative humidity. An advantageous aspect of the portable humidification device 1 is the ability to provide a desired amount of humidity for a desired amount of time, without re-hydration or re-fill of liquid into the container 4. These factors may be adjusted based on the size of the container 4 and the number of openings provided within the wall 2 of the portable humidification device 1. For example, a size of the overall container 4 may be increased for a longer period of humidification before re-hydration or re-fill of liquid is necessary and a size of the overall container 4 may be reduced for a shorter period of humidification before re-hydration or re-fill of liquid is necessary. Further, for example, as a number of openings in the wall 2 is increased, the amount of humidification is increased. In experimentation of the portable humification device 1, wall 2 included thirty-five (35) openings in order to provide a relative humidity of 70% within an enclosure.

In alternative embodiments, portable humidification device 1 may be provided with a plurality of walls with various numbers of openings in order to allow a user to select the wall to provide a desired level of humidification. As shown in FIG. 4, wall 2 may be removably connected to container 4 via a threaded connection. Advantageously, a wall 2 with the appropriate number of openings may be selected and installed in order to provide a desired amount of humidification. Additionally, portable humidification device 1 may include a shield which may be configured to cover a portion of the openings of wall and may reduce an amount of humidification by covering more openings of the wall.

EXAMPLE 1

It is contemplated that cigars should be maintained in an environment whereby the relative humidity is 70%. When a cigar is placed within a sealable bag which is five inches by eleven inches, the relative humidity within the sealable bag dropped to 45% after 24 hours. A portable humidification device 1 of a diameter as depicted in FIG. 2 was placed within a sealable bag which is five inches by eleven inches with a cigar. Container 4 of portable humidification device 1 included 0.2303 cubic inches. The portable humidification device 1 included super absorbent polymer crystals as a liquid absorbing material and included propylene glycol wetting solution. After 21 days within the sealable bag, the relative humidity was at or above 70% for the entirety of the 21 days.

It is contemplated that portable humidification device may be combined with other decorative or functional elements, such as a hygrometer or time keeping device, which do not impact the function of the humidification device but may provide additional benefits. In one embodiment, a hygrometer or time keeping device may be removably attached to the portable humidification device 1.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

The invention claimed is:

1. An apparatus, comprising:

a container, the container configured to retain a quantity of a liquid, the liquid including propylene glycol or water, the container formed of at least one of plastic, metal, ceramic, polycarbonate, or stone;

a liquid absorbing material disposed within the container, the liquid absorbing material including a plurality of super absorbing polymer crystals in bead form; and a wall coupled to the container, the wall formed of at least one of rubber, urethane, or composite material, wherein the wall includes at least one opening configured to allow passage of a liquid into the container and configured to allow passage of vapor through the at least one opening of the wall, wherein a size of each opening of the at least one opening of the wall is 0.0315-0.0385 inches.

2. The apparatus as claimed in claim 1, wherein the wall is removably coupled to the container.

3. The apparatus as claimed in claim 1, wherein the wall is configured to be depressed within the container in order to extract air from within the container and pump liquid through the at least one opening of the wall when the container is submerged in liquid or a stream of liquid.

4. The apparatus as claimed in claim 1, wherein the wall is mechanically attached to the container.

5. The apparatus as claimed in claim 4, wherein the wall is mechanically attached to the container through a threaded connection.

6. The apparatus as claimed in claim 1, wherein the wall is at least 0.06 inches thick.

7. The apparatus as claimed in claim 1, wherein the container has a volume of 0.2303 cubic inches.

* * * * *